US011214994B2

(12) United States Patent
Han et al.

(10) Patent No.: US 11,214,994 B2
(45) Date of Patent: Jan. 4, 2022

(54) RETRACTABLE OUTSIDE DOOR HANDLE ASSEMBLY FOR VEHICLE

(71) Applicants: Hyundai Motor Company, Seoul (KR); Kia Motors Corporation, Seoul (KR)

(72) Inventors: Jongho Han, Seoul (KR); Kyoung Taek Kwak, Gyeonggi-do (KR); Jinwoo Nam, Seoul (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 490 days.

(21) Appl. No.: 16/207,873

(22) Filed: Dec. 3, 2018

(65) Prior Publication Data

US 2020/0071973 A1 Mar. 5, 2020

(30) Foreign Application Priority Data

Aug. 31, 2018 (KR) ..... 10-2018-0103491

(51) Int. Cl.
*E05B 85/10* (2014.01)
*E05F 15/603* (2015.01)
(Continued)

(52) U.S. Cl.
CPC ..... *E05B 85/107* (2013.01); *E05B 79/06* (2013.01); *E05B 85/103* (2013.01);
(Continued)

(58) Field of Classification Search
CPC ..... E05B 85/10; E05B 85/103; E05B 85/107; E05B 79/14; E05B 79/16; E05B 79/22; Y10S 292/31
See application file for complete search history.

(56) References Cited

U.S. PATENT DOCUMENTS 3,418,681 A * 12/1968 Szabo ..... A45C 13/22 16/405
3,993,338 A 11/1976 Cherbourg et al.
(Continued)

FOREIGN PATENT DOCUMENTS

CN 101899931 A 12/2010
CN 204754512 U 11/2015
(Continued)

OTHER PUBLICATIONS

Extended European Search Report for European Patent Application No. 18207270, dated May 20, 2019, 8 pages.

*Primary Examiner* — Carlos Lugo
(74) *Attorney, Agent, or Firm* — Mintz Levin Cohn Ferris Glovsky and Popeo, P.C.; Peter F. Corless

(57) ABSTRACT

A retractable outside door handle assembly for a vehicle is provided. The assembly includes an outside door handle that protrudes outward in a width direction of a vehicle or is receivable into an opening formed at a door outer panel. A front link has a first end portion connected to be rotatable with a front portion of the outside door handle along the length direction of the vehicle. A connecting link connected to be rotatable with a second end portion of the front link at a first end portion thereof and installed to be movable along the length direction of the vehicle. A rear link includes a first end portion connected to be rotatable with a second end portion of the connecting link and a second end portion is connected to be rotatable with the outside door handle.

14 Claims, 13 Drawing Sheets

(51) Int. Cl.
*E05B 79/06* (2014.01)
*E05B 81/06* (2014.01)

(52) U.S. Cl.
CPC ..... *E05F 15/603* (2015.01); *E05Y 2201/434* (2013.01); *E05Y 2201/626* (2013.01); *E05Y 2201/694* (2013.01); *E05Y 2800/11* (2013.01); *Y10S 292/31* (2013.01)

(56) References Cited

U.S. PATENT DOCUMENTS

| | | | | |
|---|---|---|---|---|
| 4,093,289 | A * | 6/1978 | Inabayashi | E05B 81/25 292/201 |
| 4,573,723 | A * | 3/1986 | Morita | E05B 81/25 292/336.3 |
| 4,885,954 | A * | 12/1989 | Wanlass | E05B 81/25 356/73.1 |
| 5,088,347 | A * | 2/1992 | Wanlass | E05B 81/25 192/84.951 |
| 5,123,687 | A | 6/1992 | Pfeiffer et al. | |
| 5,558,372 | A * | 9/1996 | Kapes | E05B 83/36 292/336.3 |
| 5,975,597 | A * | 11/1999 | Makiuchi | E05B 85/16 292/336.3 |
| 9,022,435 | B2 * | 5/2015 | Park | B60R 16/005 292/217 |
| 9,103,143 | B2 | 8/2015 | Wheeler et al. | |
| 10,378,254 | B1 * | 8/2019 | Salter | E05B 85/16 |
| 10,550,611 | B2 * | 2/2020 | Och | E05B 85/107 |
| 10,655,371 | B2 * | 5/2020 | Soonthornwinate | E05B 77/06 |
| 10,907,387 | B2 * | 2/2021 | Och | E05B 81/78 |
| 10,941,595 | B2 * | 3/2021 | Patel | E05B 85/107 |
| 2002/0117864 | A1 | 8/2002 | Schlack | |
| 2004/0074326 | A1 * | 4/2004 | Minasian | F16D 43/02 74/89.18 |
| 2013/0038074 | A1 | 2/2013 | Mori et al. | |
| 2013/0127185 | A1 | 5/2013 | Lang et al. | |
| 2013/0241215 | A1 | 9/2013 | Halliwell et al. | |
| 2014/0047773 | A1 | 2/2014 | Johnsrud et al. | |
| 2015/0315826 | A1 | 11/2015 | Lang et al. | |
| 2016/0281397 | A1 | 9/2016 | Park et al. | |
| 2016/0298366 | A1 | 10/2016 | Och | |
| 2017/0218667 | A1 | 8/2017 | Lane et al. | |
| 2018/0058113 | A1 * | 3/2018 | Han | E05B 85/103 |

FOREIGN PATENT DOCUMENTS

| | | | | |
|---|---|---|---|---|
| CN | 106193844 | A | 12/2016 | |
| CN | 107780729 | A | 3/2018 | |
| CN | 108222714 | A | 6/2018 | |
| DE | 1457243 | A1 * | 1/1969 | A45C 13/22 |
| DE | 4002963 | C1 | 7/1991 | |
| DE | 19808024 | A1 * | 9/1999 | E05B 1/00 |
| DE | 102007002700 | A1 * | 7/2008 | E05B 85/107 |
| DE | 102014005797 | A1 * | 10/2015 | E05B 85/107 |
| EP | 2524096 | A1 | 11/2012 | |
| GB | 2536671 | A | 9/2016 | |
| JP | H06-193329 | A | 7/1994 | |
| JP | 2006-336230 | A | 12/2006 | |
| KR | 1020090050830 | * | 5/2009 | |
| KR | 101637820 | B1 | 7/2016 | |
| WO | 2011086144 | A1 | 7/2011 | |
| WO | 2016/188663 | A1 | 12/2016 | |
| WO | 2018/010939 | A1 | 1/2018 | |

* cited by examiner

RETRACTABLE OUTSIDE DOOR HANDLE ASSEMBLY FOR VEHICLE

CROSS-REFERENCE TO RELATED APPLICATION

This application claims priority to and the benefit of Korean Patent Application No. 10-2018-0103491 filed on Aug. 31, 2018, the entire contents of which are incorporated herein by reference.

BACKGROUND

(a) Field of the Invention

The present invention relates to a retractable outside door handle assembly for a vehicle, and more particularly, to a retractable outside door handle assembly for a vehicle, in which an outside door handle is received inside a door outer panel or protrudes outside the door outer panel.

(b) Description of the Related Art

In general, a vehicle has a predetermined size of cabin formed therein, and cabin opening/closing doors are provided for opening/closing the cabin. In particular, an inside door handle is mounted on an inside surface toward a cabin inside of the door, and an outside door handle is mounted on an outside surface toward the cabin outside of the door. Each door handle is connected to be interworked with a door latch to fix the door to a vehicle body to allow the door to be opened while the door latch is released based on an operation of each door handle. The outside door handle is generally mounted to be pivotally movable on the outer panel of the door, and in this case, the outside door handle is installed on the door outer panel to protrude outward along a width direction of the vehicle to allow the passenger to easily hold the outside door handle.

As above-described, if the outside door handle is installed to protrude outwardly along a width direction of the vehicle, operation convenience of the passenger is improved, however exterior aesthetics of the vehicle may be deteriorated due to the protruded door handle. Additionally, a running noise may occur while the vehicle being driven and running performance may be also deteriorated due to running resistance.

Recently, to solve these problems, a retractable outside door handle, in which the outside door handle protrudes outwardly along the width direction of the vehicle from the door outer panel or is received inside a receiving aperture formed in the door outer panel by the driving of an actuator (a motor) to not protrude from the door outer panel outside, has been developed. The conventional retractable outside door handle assembly may have the outside door handle protrude from the door outer panel via a link mechanism or may receive the door handle inside the receiving aperture of the door outer panel through the actuator, and is connected to a door lock mechanism including a key cylinder operated for locking or releasing the door to the vehicle body and a door latch mechanism directly locking or releasing the door to/from the vehicle body.

However, in the structure of the conventional retractable outside door handle assembly, since the link mechanism retracting the outside door handle includes four-node links, to elongate a protruding length of the outside door handle for the operation convenience of the user, the length of the four-node links must be long, and accordingly, since the size of the handle housing must be increased, there are drawbacks that weight and cost are increased and the exterior aesthetics of the protruding outside door handle decreases.

The above information disclosed in this section is merely for enhancement of understanding of the background of the invention and therefore it may contain information that does not form the prior art that is already known in this country to a person of ordinary skill in the art.

SUMMARY

An exemplary embodiment of the present invention provides a retractable outside door handle assembly for a vehicle, in which a stroke of the outside handle may be made longer with a vertically short layout, a freedom degree of design may be improved and operation reliability may also be improved as the outside handle is linearly protruded and received, and a connectivity with other parts such as the door latch is improved to be widely used.

A retractable outside door handle assembly for a vehicle according to an exemplary embodiment of the present invention may include, an outside door handle that protrudes outward in a width direction of a vehicle rather than a door outer panel configuring a door of the vehicle or being receivable to an opening formed at the door outer panel; a front link of which a first end portion is connected to be rotatable with a front portion of the outside door handle along the length direction of the vehicle; a connecting link connected to be rotatable with a second end portion of the front link at the first end portion thereof and installed to be movable along the length direction of the vehicle; and a rear link of which a first end portion is connected to be rotatable with the second end portion of the connecting link and a second end portion of the rear link may be connected to be rotatable with the outside door handle.

A supporting link may have a first end portion connected to be rotatable with a predetermined portion of the rear link and a second end portion of the supporting link may be connected to be rotatable with the door outer panel. A housing in which the links are accommodated may be further included; and one or more guide apertures which guide the movement of the connecting link may be formed in the housing. The first end portion and the second end portion of the connecting link may be fastened to the front link and the rear link, respectively; and the pins may be inserted to be movable into the one or more guide apertures to be guided. The one or more guide apertures may include a front guide aperture and a rear guide aperture disposed back and forth along the length direction of the vehicle.

An emergency aperture may be formed to communicate with the rear guide aperture into which the pin fastening the second end portion of the connecting link and the first end portion of the rear link may be inserted to be movable and guided. Thus, the pin may be inserted into the emergency aperture to be movable. The width of the emergency aperture may be formed to be greater than the width of the rear guide aperture. An actuator pushing the connecting link backward along the length direction of the vehicle may be further included.

The actuator may include a drive gear configured to receive external power to rotate; a driven gear engaged with the drive gear to rotate; and a sector gear engaged with the driven gear and rotated to push the connecting link. The connecting link and the rear link may be fastened via a pin; and a protrusion that pushes the pin may be provided at the sector gear. The outside door handle may include an outside door handle body having a holding aperture into which a hand of the user may be inserted to hold the handle; and an outside door handle base coupled to the outside door handle body and to which the front link and the rear link may be fastened. An outside door handle cover may be detachably coupled to an outer side surface of the outside door handle body along the width direction of the vehicle.

The outside door handle body may include an upper side surface along the height direction of the vehicle and an outer side surface along the width direction of the vehicle, and an opened shape not having a lower side surface along the height direction of the vehicle and an inner side surface along the width direction of the vehicle. A housing in which the links are accommodated may be further included the link; and a sealing cover may be disposed between the housing and the door outer panel. A door latch lever rotated by the connecting link to release a door latch may be further included.

The door latch lever may be disposed to be overlapped with the route of the rear guide aperture to be rotated by the connecting link. The door latch lever may include a rotation pin supported to be rotatable by the housing; a lever body formed integrally with the rotation pin and provided with a connection aperture connected with the door latch via a cable or rod; and an arm that extends from the lever body and disposed to be overlapped with the route of the rear guide aperture.

A boss may be formed to protrude from the housing; a stopper protrusion for limiting the rotation movement of the rotation pin over a predetermined angle may be formed at the boss; and a protrusion may be formed at the rotation pin to contact with the stopper protrusion and limit the rotation movement of the rotation pin. A return restricting protrusion may be formed at the boss and thus, the arm may contact the return restricting protrusion to return to an original position during the arm is returned.

According to the retractable outside door handle assembly for the vehicle according to an exemplary embodiment of the present invention, a stroke of the outside door handle may be made longer with a vertical short four-node links to thus improve the layout. Additionally, since the outside door handle may protrude linearly, a freedom degree of design may be improved. For an emergency such as actuator failure or battery discharge, the door may be opened by protruding the outside door handle to the outside of the vehicle width direction without any additional tools being required and thus, the emergency response performance may be improved and the merchantability of the vehicle may also be able to be improved.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, combustion, plug-in hybrid electric vehicles, hydrogen-powered vehicles and other alternative fuel vehicles (e.g. fuels derived from resources other than petroleum).

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Although exemplary embodiment is described as using a plurality of units to perform the exemplary process, it is understood that the exemplary processes may also be performed by one or plurality of modules. Additionally, it is understood that the term controller/control unit refers to a hardware device that includes a memory and a processor. The memory is configured to store the modules and the processor is specifically configured to execute said modules to perform one or more processes which are described further below.

Hereinafter, an exemplary embodiment of the present invention will be described in detail with reference to the accompanying drawings.

Figure 1:
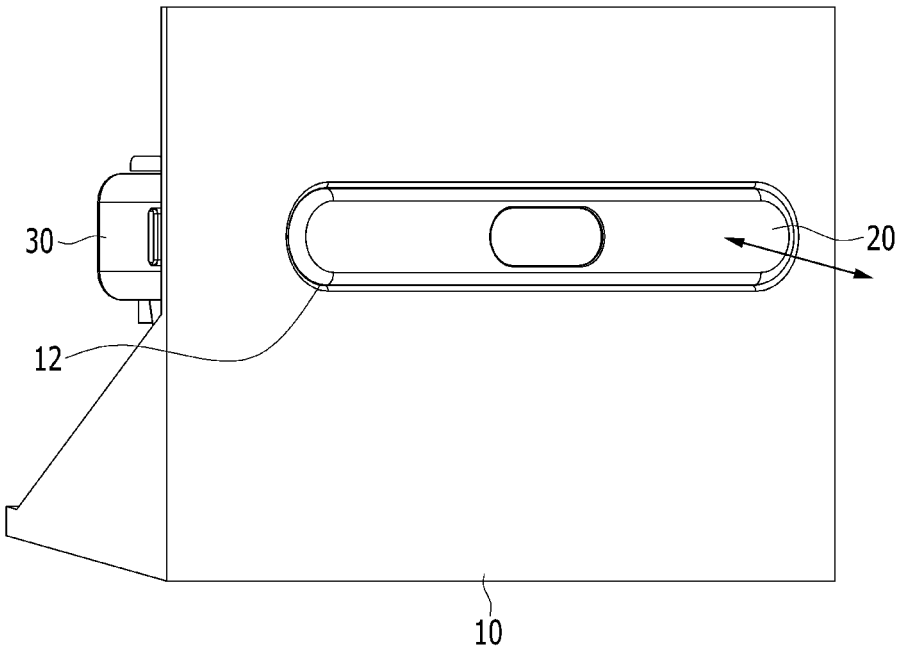
FIG. 1 is a perspective view of a state in which a retractable outside door handle assembly for a vehicle according to an exemplary embodiment of the present invention is mounted on a door outer panel.
Figure 2:
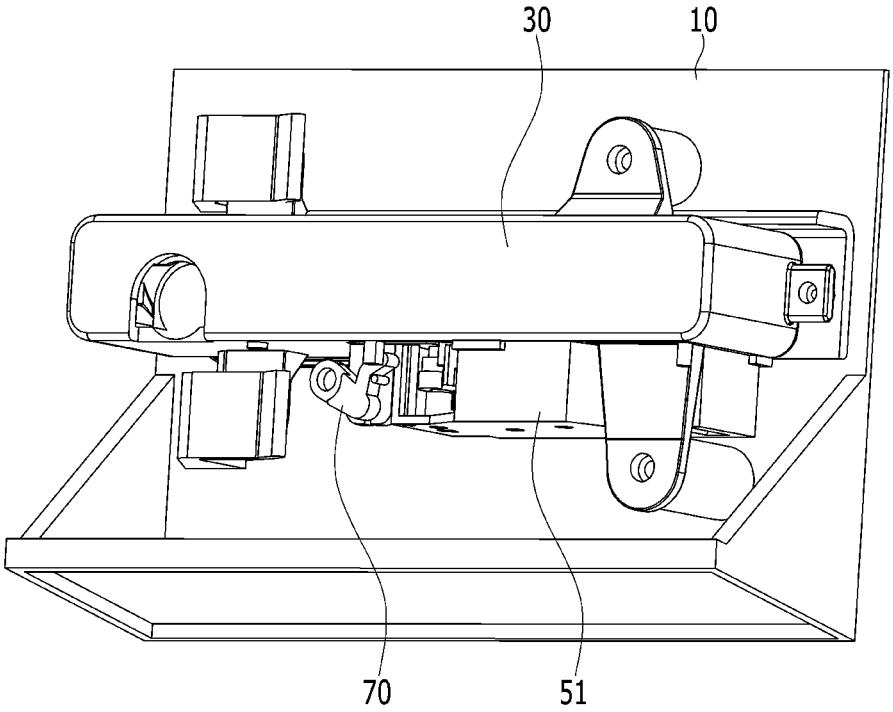
FIG. 2 is a rear perspective view of FIG. 1 according to an exemplary embodiment of the present invention.
Figure 3:
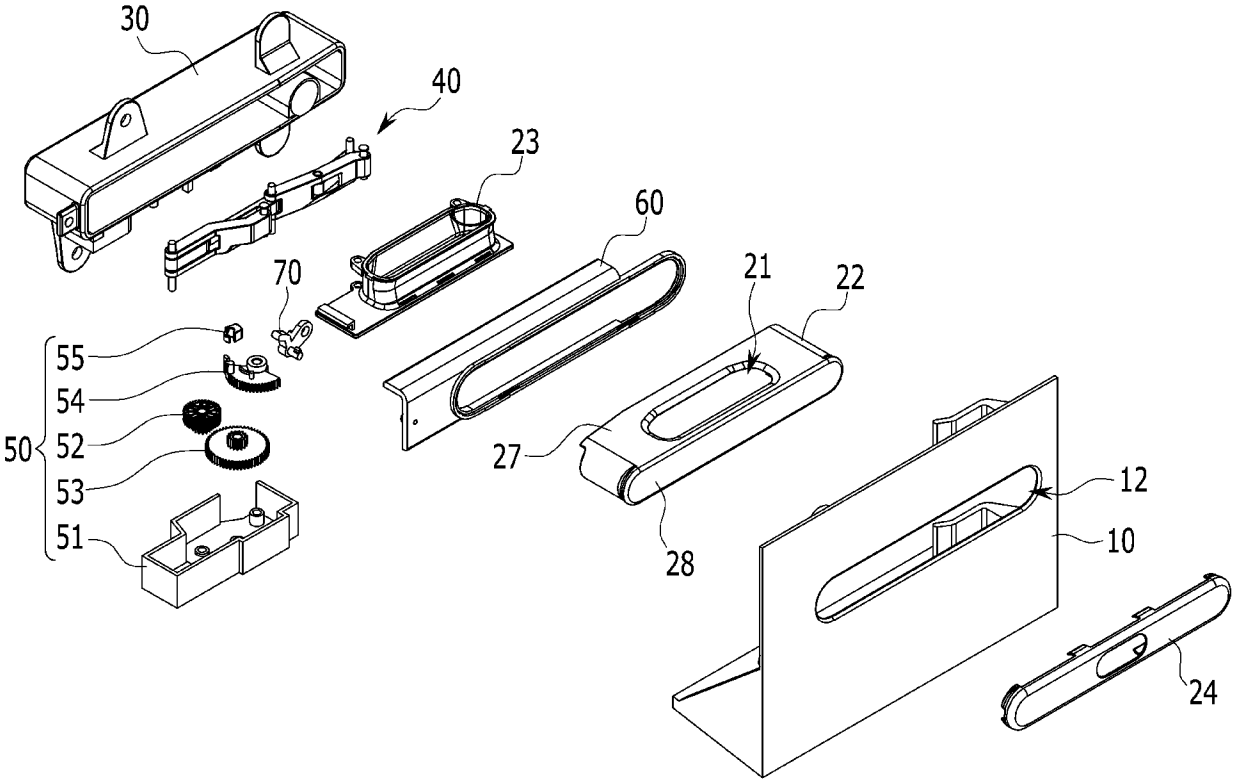
FIG. 3 is an exploded perspective view of the retractable outside door handle assembly for the vehicle according to an exemplary embodiment of the present invention.

Referring FIG. 1 to FIG. 3, a retractable outside door handle assembly for a vehicle according to an exemplary embodiment of the present invention may include an the outside door handle 20 that protrudes outward (e.g., toward an outside of the vehicle) in a width direction of a vehicle rather than a door outer panel 10 through an opening 12 formed on a door outer panel 10 or may be received in the opening 12 to form almost the same plane as an outside surface of the door outer panel 10.

The outside door handle 20 may be installed to be movable in the width direction of the vehicle in a housing 30 disposed inward in a width direction of the vehicle rather than the door outer panel 10 and mounted at the door outer panel 10 to be fixed. The retractable outside door handle assembly for a vehicle according to an exemplary embodiment of the present invention may include a link mechanism 40 of which a first side portion may be fastened to the outside door handle 20 and a second side portion may be supported by the housing 30 to move the outside door handle 20 in a horizontal direction, and an actuator 50 configured to apply an operational force to the link mechanism 40 to move the outside door handle 20 through the link mechanism 40 in the horizontal direction.

The outside door handle 20 may include an outside door handle body 22 with a holding aperture 21 into which a hand of the user may be inserted to hold the outside door handle body 22; and an outside handle base 23 coupled to the outside door handle body 22 and fastened with the link mechanism 40. An outside door handle cover 24 may be coupled to an outer side surface of the outside door handle body 22.

When the outside door handle 20 is mounted on the door outer panel 10, the outside door handle cover 22 may first be coupled to an outer side surface of the outside door handle body 22 to prevent scratches of the outside door handle 20 and may guide the outside door handle 20 to be assembled with a constant gap with respect to the opening 12 of the door outer panel 10. After the mounting of the outside door handle 20 is complete, the outside door handle cover 22 may be separated from the outside door handle 20.

Additionally, the outside door handle body 22 may include only an upper side surface 27 along a height direction of a vehicle and an outer side surface 28 along a width direction of a vehicle. In other words, the outside door handle body 22 may omit a lower side surface along the height direction of a vehicle and an inner side surface along the width direction of a vehicle to form an open shape. Thus, the painting of the component becomes easier and the paint film may be applied more uniformly throughout the outside door handle body 22 during, for example, spray painting, thereby improving an outer appearance of the outside door handle 20. A sealing cover 60 may be disposed between the housing 30 and the door outer panel 10 to prevent foreign material from entering through the opening 12 of the door outer panel 10.

Figure 4:
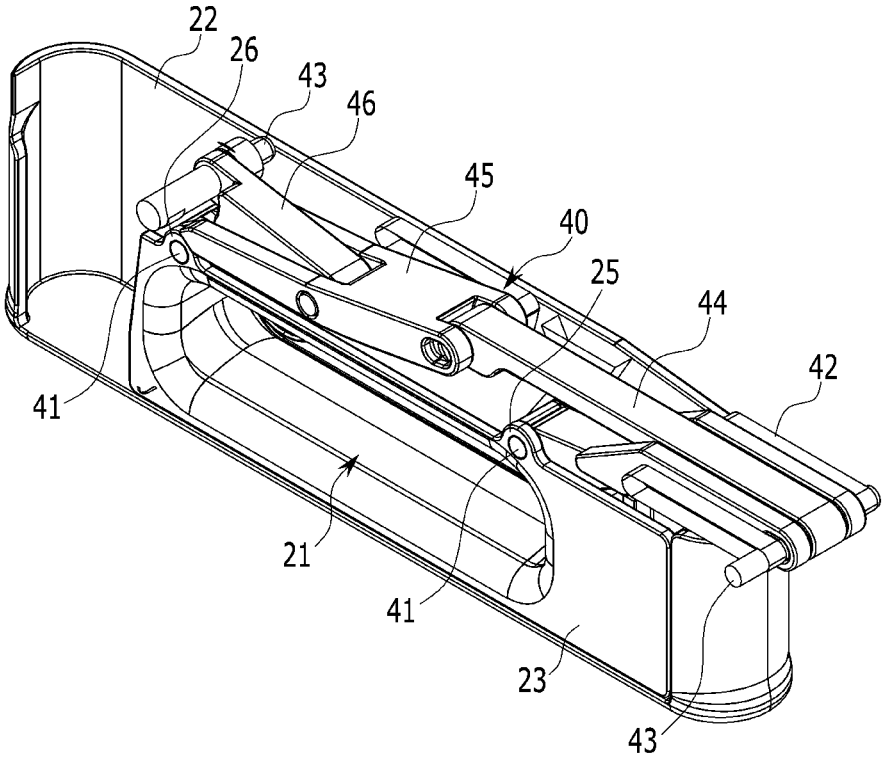
FIG. 4 is a coupling perspective view of a link mechanism and an outside door handle according to an exemplary embodiment of the present invention.
Figure 5:
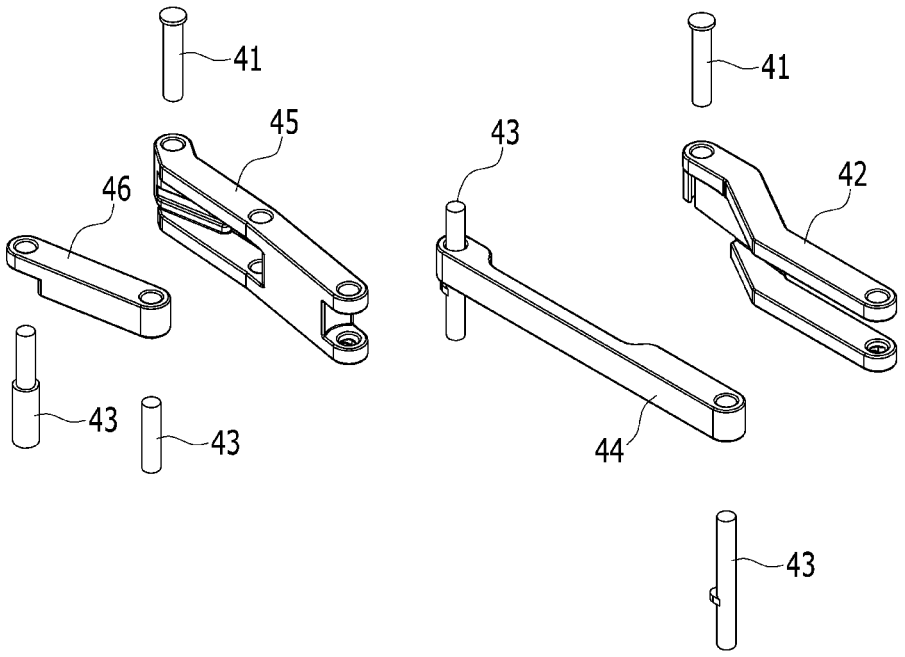
FIG. 5 is a detailed perspective view of the link mechanism according to an exemplary embodiment of the present invention.

Referring to FIG. 4, a front boss 25 position at the front and a rear boss 26 positioned at the rear along the length direction of the vehicle may be integrally formed with an inner side surface of the outside door handle base 23 along the width direction of the vehicle, a fastening aperture may be formed at the front boss 25 and the rear boss 26, respectively, and a first side portion of the link mechanism 40 may be fastened to each the fastening aperture with a pin 41. Referring to FIG. 4 and FIG. 5, the link mechanism 40 may include a front link 42 having a first end portion fastened to the front boss 25 with the pin 41 to be rotatable, a connecting link 44 having a first end portion fastened to a second end portion of the front link 42 with a pin 43 to be rotatable, a rear link 45 having a first end portion fastened to a second end portion of the connecting link 44 with a pin 43 to be rotatable and a second end portion of the rear link 45 may be fastened to the rear boss 26 with the pin 43 to be rotatable, and a supporting link 46 having a first end portion fastened to a portion the rear link 45 along a length direction thereof with the pin 43 to be rotatable and a second end portion of the supporting link 46 may be fastened to the housing 30 with the pin 43 to be rotatable. Therefore, the outside door handle 20, the front link 42, the connecting link 44 and the rear link 45 may form a four-node link.

Figure 6:
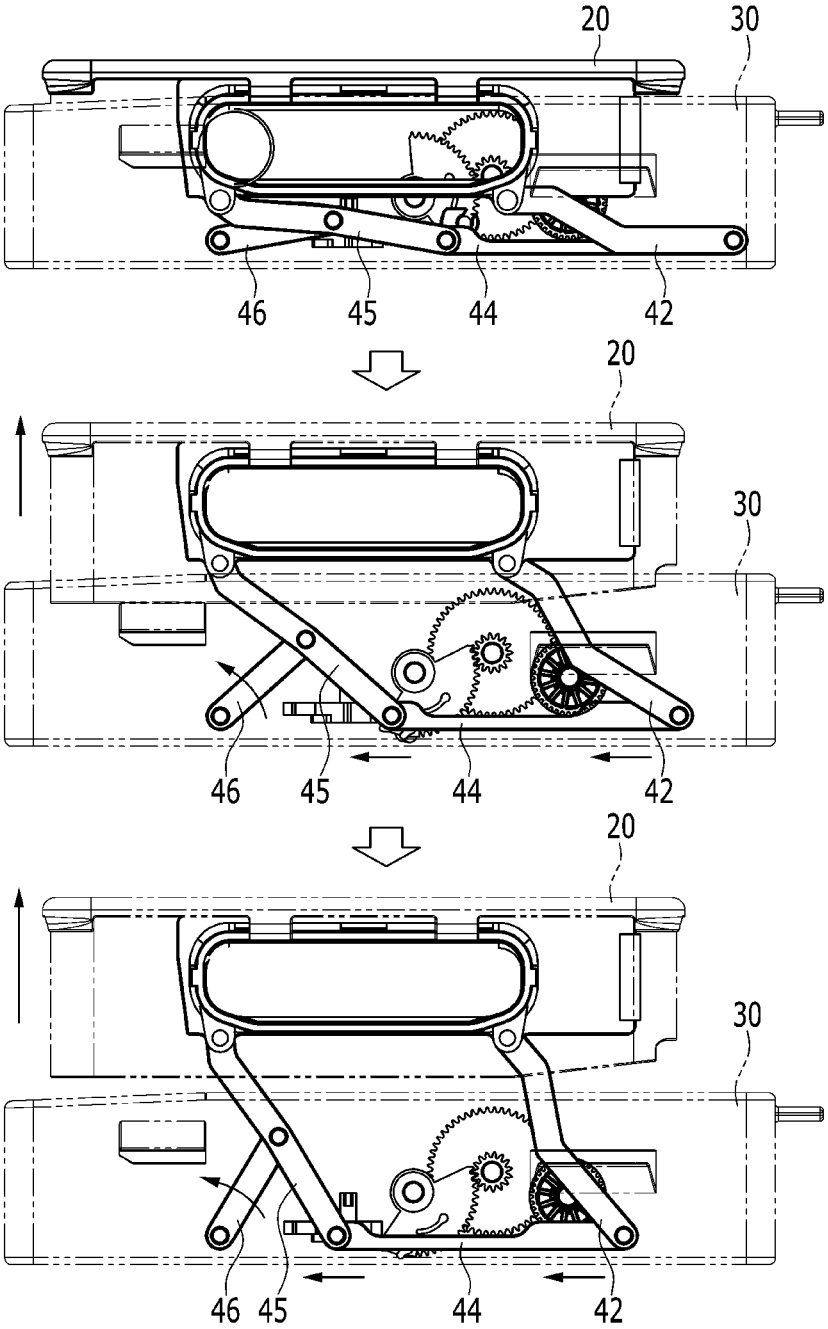
FIG. 6 is a diagram explaining the operation of the outside door handle according to an exemplary embodiment of the present invention.

Referring to FIG. 6, when the connecting link 44 of the link mechanism 40 moves by the actuator 50 backwards along the length direction of the vehicle, the front link 42 and rear link 45 may be deployed out of the width direction of the vehicle to protrude the outside door handle 20 out of the width direction of the vehicle, and thus, the outside door handle 20 protrudes further in the width direction of the vehicle than outside the door outer panel 10. The user may then insert a hand into the holding aperture 21 of the outside door handle 20 and pull the outside door handle 20 to release the door latch and the door may be opened.

Figure 7:
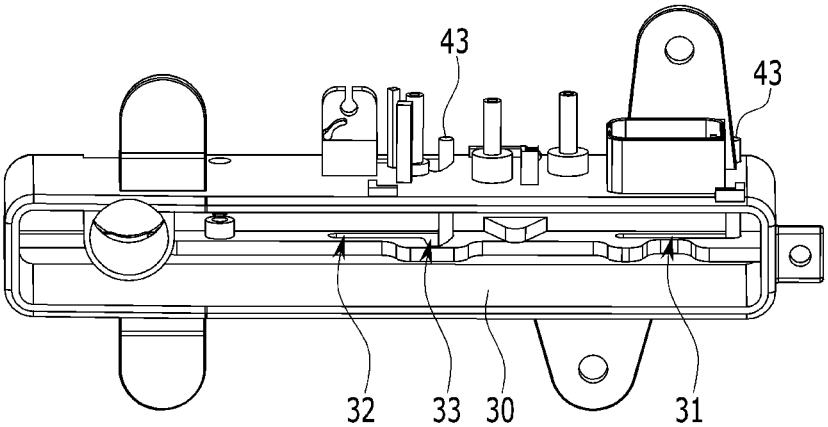
FIG. 7 is an incision perspective view of a housing according to an exemplary embodiment of the present invention.
Figure 8:
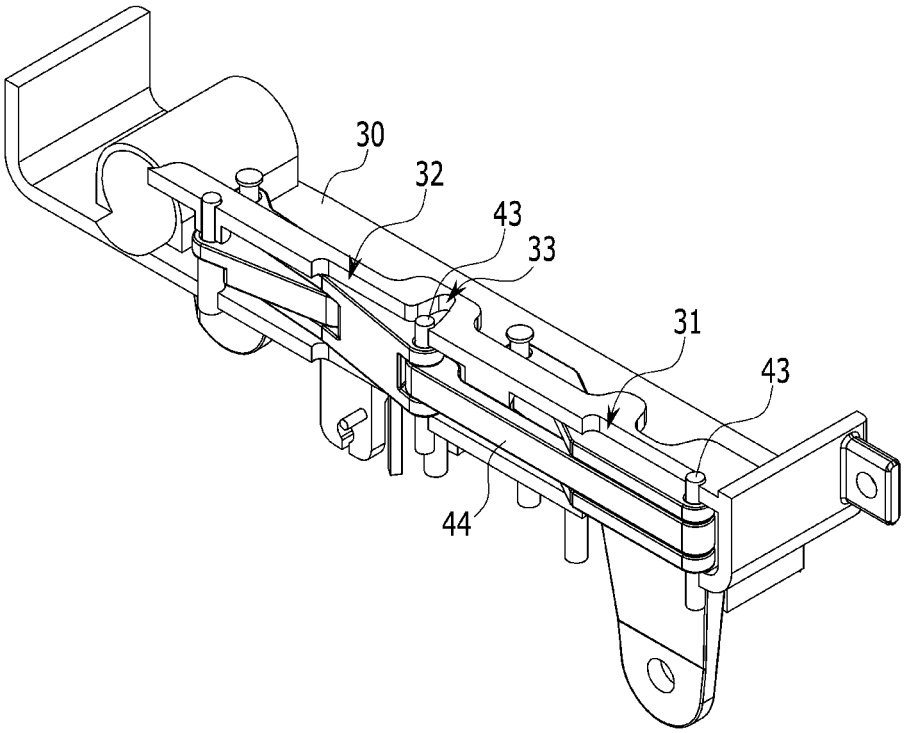
FIG. 8 is another incision perspective view of the housing according to an exemplary embodiment of the present invention.

Referring to FIG. 7 and FIG. 8, when the connecting rod 44 is moved by the actuator 50, two front guide apertures 31 for guiding the linear movement of the connecting rod 44 and a rear guide aperture 32 may be formed at one side surface of the housing 30 while disposed apart from each other along the length direction of the vehicle. In other words, the two guide aperture 31 and 32 may be formed in a linear line along the length direction of the vehicle, two pins 43 fastened to both end portions of the connecting link 44 may be inserted into the two guide apertures 31 and 32, and two pins 43 may be moved along the guide apertures 31 and 32 and thus, the connecting link 44 may be guided by the actuator 50 back and forth along the length direction of the vehicle.

Figure 9:
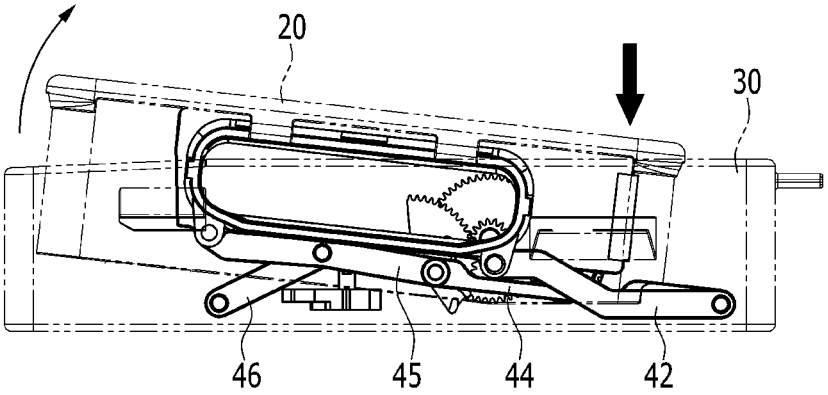
FIG. 9 is a diagram illustrating the operation of the outside door handle according to an exemplary embodiment of the present invention in an emergency situation.

Furthermore, an emergency aperture 33 may be formed at a first end portion of the rear guide aperture 32 to be wider than the width of the rear guide aperture 32 in the width direction of the vehicle. The emergency aperture 33 may be formed to be in communication with the rear guide aperture 32. Accordingly, when the actuator 50 fails to operate due to failure or battery power supply interruption, an occupant is required to manually manipulate the outside door handle 20. With the outside door handle 20 housed inside the opening 12 of the door outer panel 10, as shown in FIG. 9, when the occupant presses the front portion along the length direction of the vehicle of the outside door handle 20, the pin 43 fastened to the second end of the connecting link 44 is received in the interior of the emergency aperture 33 and thus, the rear portion of the outside door handle 20 may be subjected to a pivot motion in which the rear portion of the outside door handle 20 protrudes further outward along the width direction of the vehicle than the door outer panel 10. Accordingly, the occupant may grasp the protruded rear portion of the outside door handle 20 by hand and pull the handle out of the width direction of the vehicle, and then the outside door handle 20 may protrude from the door outer panel 10 to open the locked door.

In other words, the merchantability of the vehicle may be improved since the door is capable of being opened by protruding the outside door handle 20 without an additional tool in the emergency situation of the failure of the actuator 50. Additionally, not shown in detailed, the supporting link 46 may be connected with a spring (not shown) and the spring may be configured to apply an elastic force to the supporting link 46 to pull the supporting link 46 in a clockwise direction (e.g., the direction in which the outside door handle 20 is received inside the opening 12 of the door outer panel 10), to rotate the supporting link 46 in the clockwise direction to an original position thereof by the elastic force of the spring, the rear link 45, connecting link 44 and front link 42 may be moved together by the rotation movement of the clockwise direction of the supporting link 46, and the outside door handle 20 may be received inside the opening 12 of the door outer panel 10 again when the outside door handle 20 is released after the outside door handle 20 is popped up and the supporting link 46 rotates in an counterclockwise direction.

Figure 10:
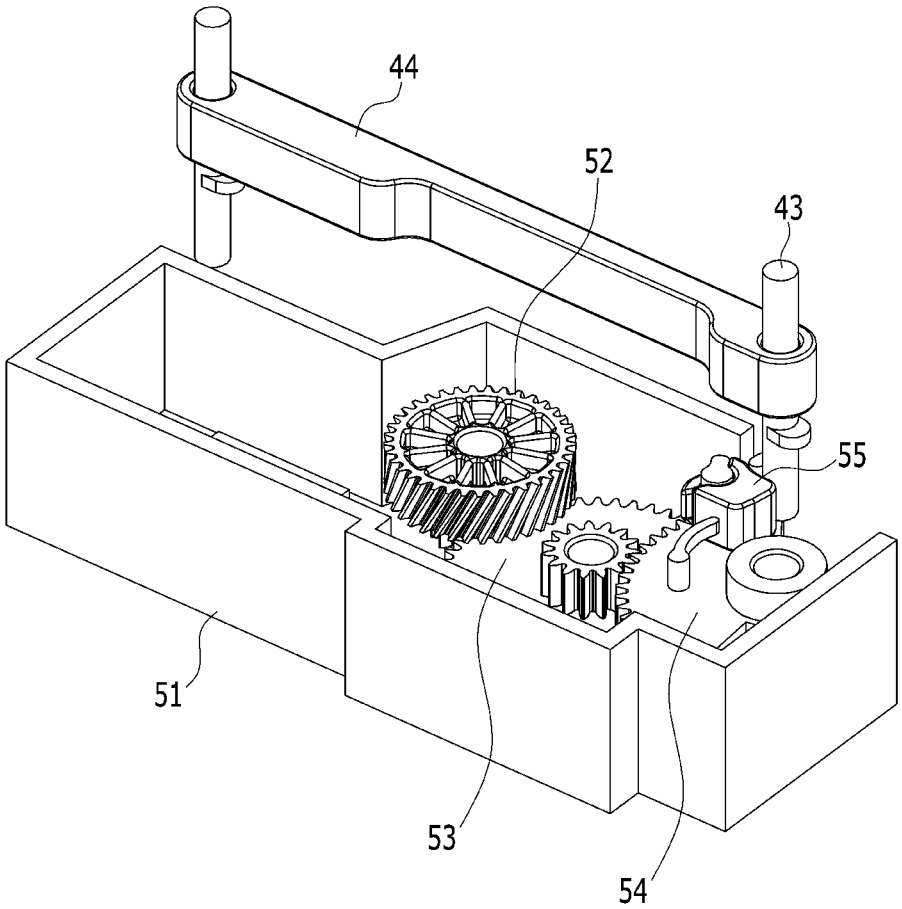
FIG. 10 is a perspective view of an actuator according to an exemplary embodiment of the present invention.
Figure 11:
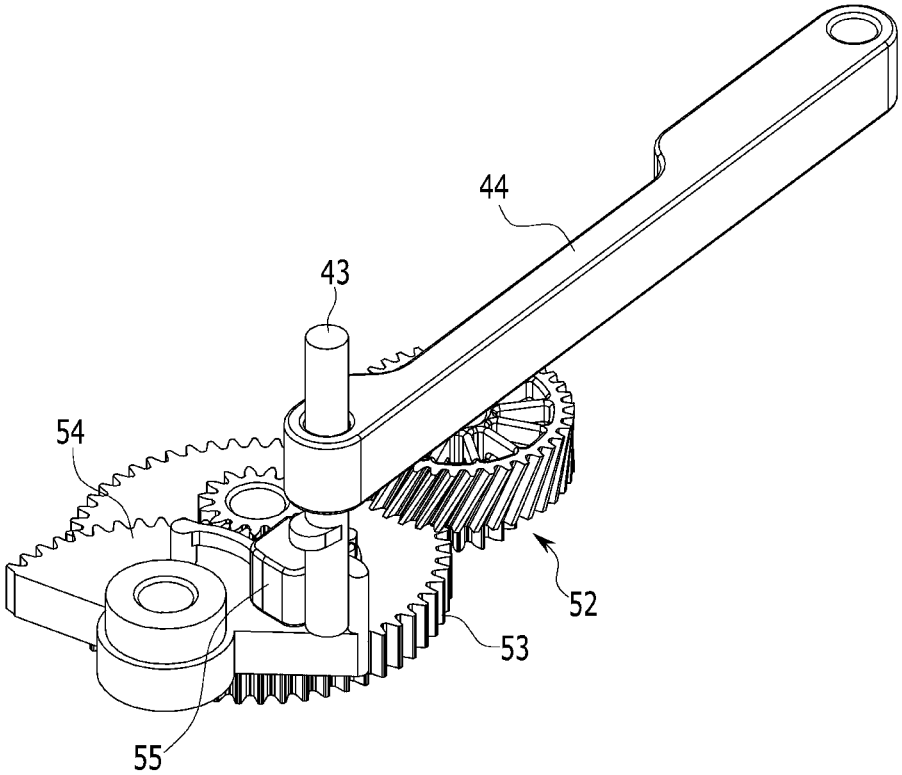
FIG. 11 is another perspective view of the actuator according to an exemplary embodiment of the present invention.

Referring to FIG. 10, FIG. 11 and FIG. 3, the actuator 50 may include a plurality of gears accommodated within an actuator housing 51. The plurality of gears may include a drive gear 52 configured to rotate to receive the torque from a drive motor (not shown), a driven gear 53 engaged with the drive gear 52, and a sector gear 54 engaged with the driven gear 53 and configured to receive the torque to rotate, and push the pin 43 fastened to the first end of the connecting link 44 forward or backward along the longitudinal direction of the vehicle.

A protrusion 55 which contacts the pin 43 of the connecting link 44 to push the pin 43, may be disposed at one side surface of the sector gear 54. Therefore, when the drive motor is actuated by a control signal of the controller, the drive gear 52, driven gear 53 and sector gear 54 may sequentially rotate to push the connecting link 44 to the rear along the length direction of the vehicle, and thus, the outside door handle 20 may be popped up from the door outer panel 20 and the occupant may open the door by manipulating the popped up outside door handle 20.

Further, the popped up outside door handle 20 may be received into the opening 12 of the door outer panel by the reverse operation of the drive motor and the opposite operation of the actuator 50 and the link mechanism 40 described above. The door latch lever 70 for opening the door latch while rotating based on the operation of the link mechanism 40, as shown in FIGS. 3 and 12, may be mounted to be rotatable on the lower surface of the housing 30.

The door latch lever 70 may include a rotation pin 71 inserted in and supported to be rotatable the boss formed in the housing 30, a lever body 72 integrally formed with the rotation pin 71 and having a connection aperture 74 connected with a door latch through a cable or a rod, and an arm 73 that extends from the lever body 72 to be overlapped with the path of the rear guide aperture 32. Accordingly, the pin 43 of the connecting link 44 pushes the arm 73 of the door latch lever 70 in the course of moving along the rear guide aperture 32, and the arm 73 rotates about its pin 71 to release the door latch by pushing or pulling the cable or rod connected to the door latch.

Figure 12:
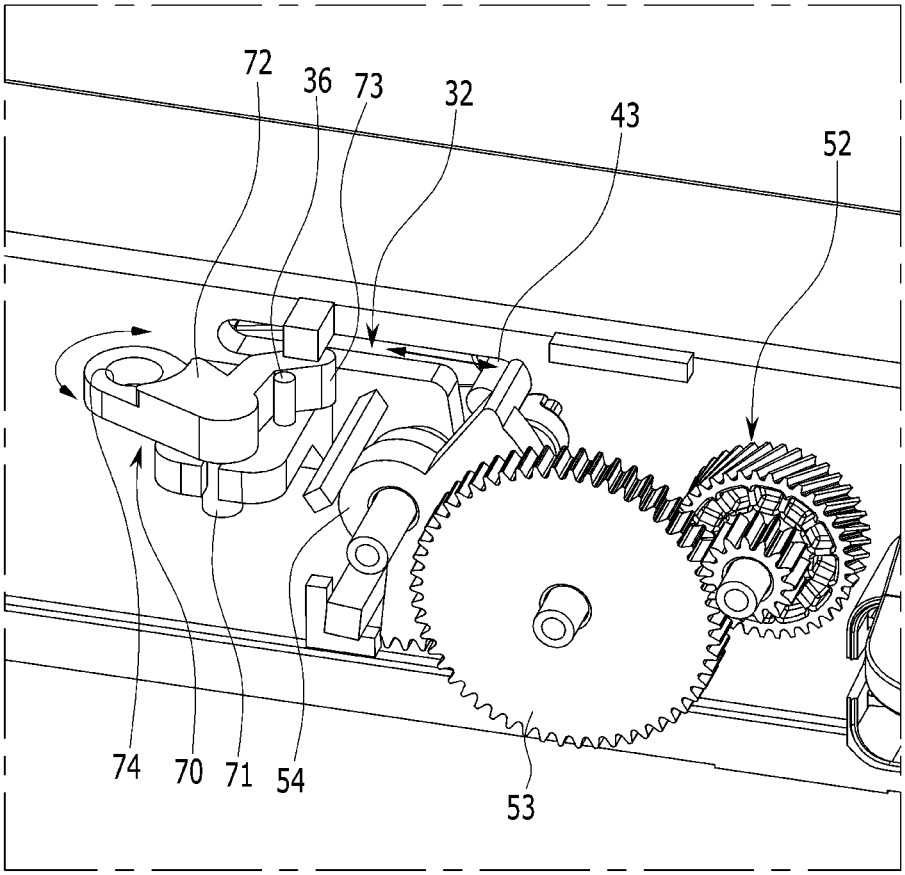
FIG. 12 is a mounting perspective view of a door latch lever according to an exemplary embodiment of the present invention.
Figure 13:
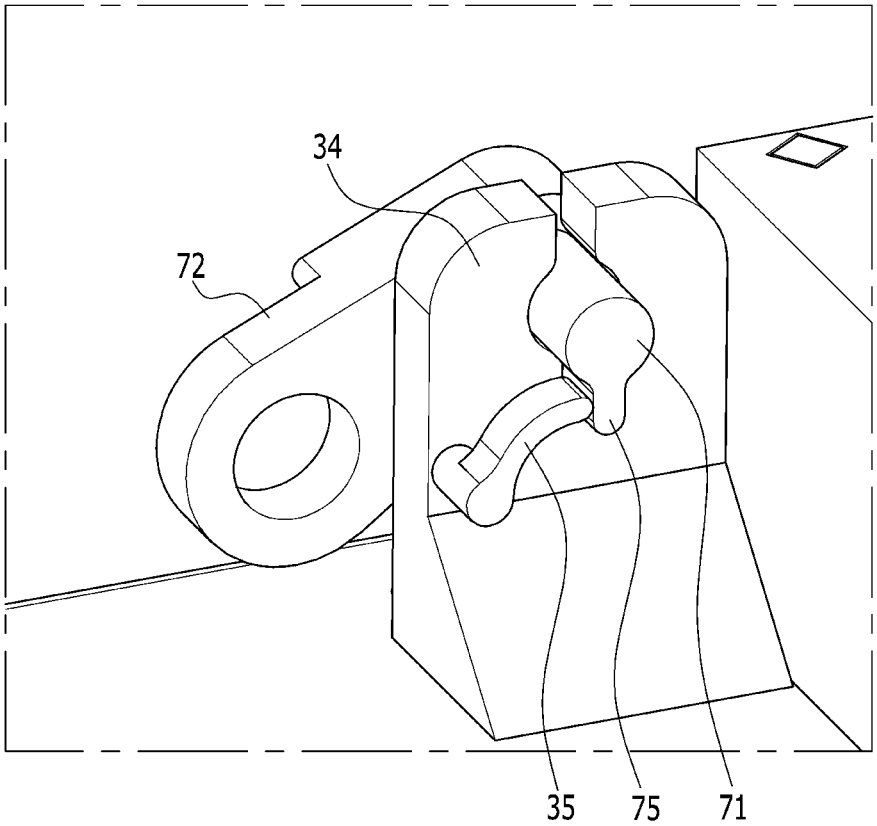
FIG. 13 is another perspective view of the door latch lever according to an exemplary embodiment of the present invention.

Referring to FIG. 12 and FIG. 13, a boss 34 may be formed in the housing 30 in a protruding manner and an assemble aperture in which the rotation pin 71 is inserted and supported by, may be formed at the boss 34. A stopper protrusion 35 may be formed on the lower surface of the boss 34 to restrict rotation of the rotation pin 71 by a predetermined angle or more. A protrusion 75 may be formed on the rotation pin 71 to contact the stopper protrusion 35 to prevent rotation of the rotation pin 71. Accordingly, when the door latch lever 70 is rotated by the operation of the outside door handle 20, the door latch lever 70 may rotate only up to a predetermined angle by the mutual contact of the stopper protrusion 35 and the protrusion 75. Additionally, on the upper surface of the boss 34, a return restricting protrusion 36 may be formed. When returning the arm 73, the arm 73 may be more accurately restored to an original position by being contacted with the return restricting protrusion 36.

While this invention has been described in connection with what is presently considered to be exemplary embodiments, it is to be understood that the invention is not limited to the disclosed exemplary embodiments, but, on the contrary, is intended to cover various modifications and equivalent arrangements included within the spirit and scope of the appended claims.

DESCRIPTION OF SYMBOLS

10: door outer panel
12: opening
20: outside door handle
30: housing
40: link mechanism
42: front link
44: connecting link
45: rear link
50: actuator
52: drive gear
53: driven gear
54: sector gear
60: sealing cover
70: door latch lever

What is claimed is:

1. A retractable outside door handle assembly for a vehicle, comprising:

an outside door handle that protrudes outward in a width direction of a vehicle or is receivable into an opening formed at a door outer panel of a door of the vehicle;

a front link having a first end portion connected to be rotatable with a front portion of the outside door handle along a length direction of the vehicle;

a connecting link connected to be rotatable with a second end portion of the front link at a first end portion thereof and installed to be movable along the length direction of the vehicle;

a rear link having a first end portion connected to be rotatable with a second end portion of the connecting link and a second end portion of the rear link is connected to be rotatable with the outside door handle;

a housing in which the links are accommodated;

one or more guide apertures which guide the movement of the connecting link is formed in the housing, wherein the one or more guide apertures include a front guide aperture and a rear guide aperture disposed back and forth along the length direction of the vehicle; and an emergency aperture formed to communicate with the rear guide aperture into which the pin fastening the second end portion of the connecting link and the first end portion of the rear link is inserted to be movable and guided to allow the pin to be inserted into the emergency aperture to be movable, wherein a width of the emergency aperture is formed to be greater than a width of the rear guide aperture, wherein the first end portion and the second end portion of the connecting link are fastened to the front link and the rear link, respectively, and pins are inserted to be movable into the one or more guide apertures to be guided.

2. The retractable outside door handle assembly for the vehicle of claim 1, further comprising:

a supporting link having a first end portion connected to be rotatable with a predetermined portion of the rear link and a second end portion connected to be rotatable with the door outer panel.

3. The retractable outside door handle assembly for the vehicle of claim 1, further comprising:

an actuator configured to push the connecting link backward along the length direction of the vehicle.

4. The retractable outside door handle assembly for the vehicle of claim 3, wherein the actuator includes:

a drive gear configured to receive external power to rotate;

a driven gear engaged with the drive gear to rotate; and a sector gear engaged with the driven gear and rotated to push the connecting link.

5. The retractable outside door handle assembly for the vehicle of claim 4, wherein the connecting link and the rear link are fastened via a pin and a protrusion configured to push the pin is provided at the sector gear.

6. The retractable outside door handle assembly for the vehicle of claim 1, wherein the outside door handle includes:

an outside door handle body having a holding aperture into which a hand of a user is inserted to hold the outside door handle body; and an outside door handle base coupled to the outside door handle body and to which the front link and the rear link are fastened.

7. The retractable outside door handle assembly for the vehicle of claim 6, wherein an outside door handle cover is detachably coupled to an outer side surface of the outside door handle body along the width direction of the vehicle.

8. The retractable outside door handle assembly for the vehicle of claim 6, wherein the outside door handle body includes only an upper side surface along the height direction of the vehicle and an outer side surface along the width direction of the vehicle, and an opened shape.

9. The retractable outside door handle assembly for the vehicle of claim 6, further comprising:

a sealing cover disposed between the housing and the door outer panel.

10. The retractable outside door handle assembly for the vehicle of claim 1, further comprising:

a door latch lever rotated by the connecting link to release a door latch.

11. The retractable outside door handle assembly for the vehicle of claim 10, wherein the door latch lever is disposed to be overlapped with the route of the rear guide aperture to be rotated by the connecting link.

12. The retractable outside door handle assembly for the vehicle of claim 11, wherein the door latch lever includes:

a rotation pin supported to be rotatable by the housing;

a lever body formed integrally with the rotation pin and including a connection aperture connected with the door latch via a cable or rod; and an arm that extends from the lever body and disposed to be overlapped with the route of the rear guide aperture.

13. The retractable outside door handle assembly for the vehicle of claim 12, further comprising:

a boss formed to protrude from the housing;

a stopper protrusion configured to limit the rotation movement of the rotation pin over a predetermined angle is formed at the boss; and a protrusion formed at the rotation pin to contact the stopper protrusion and limit the rotation movement of the rotation pin.

14. The retractable outside door handle assembly for the vehicle of claim 12, wherein a return restricting protrusion is formed at the boss to allow the arm to contact the return restricting protrusion to be returned an original position.

* * * * *